United States Patent [19]

Abel et al.

[11] 4,252,534

[45] Feb. 24, 1981

[54] DYEING ASSISTANTS AND THEIR USE IN DYEING SYNTHETIC FIBRE MATERIAL

[75] Inventors: Heinz Abel, Reinach; Karlheinz Keller, Bettingen, both of Switzerland

[73] Assignee: Ciba-Geigy Corporation, Ardsley, N.Y.

[21] Appl. No.: 83,066

[22] Filed: Oct. 9, 1979

[30] Foreign Application Priority Data

| | | | |
|---|---|---|---|
| Oct. 19, 1978 | [CH] | Switzerland | 10815/78 |
| Feb. 26, 1979 | [CH] | Switzerland | 1898/79 |
| Aug. 17, 1979 | [CH] | Switzerland | 7558/79 |

[51] Int. Cl.[3] ..... C09B 67/00; D06P 1/64

[52] U.S. Cl. ..... 8/617; 8/611; 8/654; 8/907; 8/908; 8/922; 8/925; 8/927; 252/8.6

[58] Field of Search ..... 8/86, 89 R, 92, 93, 8/94 R, 617, 611, 908, 654; 252/8.6

[56] References Cited

U.S. PATENT DOCUMENTS

| | | | |
|---|---|---|---|
| 3,533,731 | 10/1970 | Shmidl et al. | 8/176 |
| 3,706,530 | 12/1972 | Baumann et al. | 8/174 |

FOREIGN PATENT DOCUMENTS 1161475 8/1969 United Kingdom .

*Primary Examiner*—A. Lionel Clingman
*Attorney, Agent, or Firm*—Edward McC. Roberts

[57] ABSTRACT

A dyeing assistat containing at least (a) an alkylbenzene or tetrahydronaphthalene (tetralin) or a mixture thereof, (b) an anionic surfactant, (c) a non-aromatic and water-immiscible solvent and optionally also (d) a polar solvent and/or (e) a non-ionic surfactant; this dyeing assistant can be used to promote the migration of the dyes and thus to improve the levelness and dye yield when dyeing synthetic fibre material, preferably polyester, in particular in the temperature range from 80° to 130° C.

32 Claims, No Drawings

DYEING ASSISTANTS AND THEIR USE IN DYEING SYNTHETIC FIBRE MATERIAL

The present invention relates to novel dyeing assistants and to their use in dyeing synthetic fibre material.

The hydrophobic nature of many synthetic fibres complicates the dyeing of these fibres and creates practical problems. If one attempts to dye such synthetic fibre material with an aqueous dispersion of a disperse dye or in the presence of a cationic dye in the absence of a carrier, then ordinarily dye does not exhaust onto the hydrophobic material, not even at the boiling point of water. To promote the penetration of the dye into the fibre material during the dyeing process it is usual to employ carriers which are suitable for this purpose.

Surprisingly, there has now been found a novel dyeing assistant which not only facilitates penetration of the dye into the material, but also promotes migration of the dye, thereby improving levelness and increasing the dye yield by at least 30%. Simultaneously, the novel assistant has a cleansing action on the fibre material.

Accordingly, the invention provides a dyeing assistant which comprises at least (a) tetralin (tetrahydronaphthalene) or preferably an alkylbenzene, or also a mixture thereof, (b) an anionic surfactant, (c) a non-aromatic and water-immiscible solvent, and optionally, (d) a polar solvent and/or (e) a non-ionic surfactant.

Preferred dye assistants contain the following components:

(a)+(b)+(c)

(a)+(b)+(c)+(e)

or in particular (a)+(b)+(c)+(d)

or (a)+(b)+(c)+(d)+(e).

The alkylbenzenes to be used as component (a) are e.g. mixtures of alkylated benzenes which are obtained by catalytic reduction of petroleum fractions. They are in particular benzene derivatives which contain one or more methyl and/or ethyl groups. Most preferably they are: toluene, xylene, trimethylbenzene, tetramethylbenzene, methyl ethyl benzene, dimethyl ethyl benzene, trimethyl ethyl benzene and ethyl benzene or mixtures thereof. Particularly satisfactory results are obtained with mixtures of methyl ethyl benzene and trimethylbenzene or of dimethyl ethyl benzene, tetramethylbenzene and trimethyl ethyl benzene. Mixtures of an alkylbenzene and tetralin can also be used as component (a).

The anionic surfactants of component (b) are preferably anionic alkylene oxide adducts, for example adducts containing acid ether groups or preferably acid ester groups of inorganic or organic acids, of alkylene oxides, in particular ethylene oxide and/or propylene oxide or also styrene oxide, with organic hydroxyl, carboxyl, amino and/or amido compounds containing aliphatic hydrocarbon radicals having a total of at least 4 carbon atoms or mixtures thereof. These acid ethers or esters can be in the form of free acids or salts, e.g. alkali metal, alkaline earth metal, ammonium or amine salts.

These anionic surfactants are obtained by known methods by addition of at least 1 mole, preferably more than 1 mole, e.g. 2 to 60 moles, of ethylene oxide or propylene oxide, or alternately, in any order, ethylene oxide and propylene oxide, to the above organic compounds, and subsequently etherifying or esterifying the adducts and, if desired, converting the ethers or esters into their salts. Suitable starting materials are higher fatty alcohols, i.e. alkanols or alkenols containing 8 to 22 carbon atoms, alicyclic alcohols, phenylphenols, benzylphenols, alkylphenols containing one or more alkyl substituents which together contain at least 4 carbon atoms, fatty acids containing 8 to 22 carbon atoms, amines which contain aliphatic and/or cycloaliphatic hydrocarbon radicals having at least 8 carbon atoms, in particular fatty amines, hydroxyalkylamines, hydroxyalkylamides and aminoalkyl esters of fatty acids or dicarboxylic acids and of higher alkylated aryloxycarboxylic acids, all of which contain such radicals.

Component (b) can be e.g. a compound of the formula

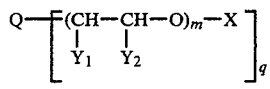

(1)

wherein Q is $R_1$—O—, $R_2$—CO—O— or $R_3$—N<, $R_1$ is an aliphatic hydrocarbon radical of 8 to 24 carbon atoms, a cycloaliphatic hydrocarbon radical of 10 to 22 carbon atoms, o-phenylphenyl or alkylphenyl containing 4 to 16 carbon atoms in the alkyl moiety, $R_2$ is an aliphatic hydrocarbon radical of 7 to 21 carbon atoms, $R_3$ is an aliphatic hydrocarbon radical of 12 to 22, in particular 12 to 18, carbon atoms, one of $Y_1$ and $Y_2$ is hydrogen, methyl or phenyl and the other is hydrogen, X is the acid radical of an inorganic oxygen-containing acid or of a dicarboxylic acid or is the radical —$CH_2COOH$, m is 1 to 50, preferably 1 to 30, and q is 1 or, if Q is $R_3$—N<, q is 2 with the proviso that the two substituents at the nitrogen atom are the same or different.

Very suitable components (b) preferably have the formula

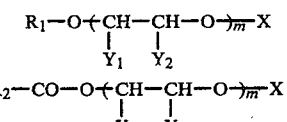

(2)

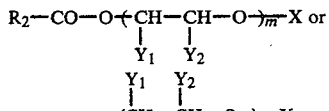

(3)

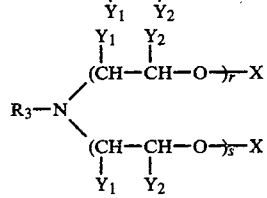

(4)

wherein $R_1$, $R_2$, $R_3$, $Y_1$, $Y_2$, X and m have the given meanings and r and s are integers, the sum of which is 2 to 15. Preferred surfactants are those of the formula (2).

The radical $R_1$—O— can be derived e.g. from alcohols containing at least 8, preferably 10 to 24, carbon atoms, for example 2-ethylhexanol, decyl, lauryl, tridecyl, myristyl, cetyl, stearyl, oleyl, arachidyl or behenyl alcohol, as well as from hydroabietyl alcohol, the alfols, or from o-phenylphenol or from alkylphenols, for example butylphenyl, hexylphenol, n-octylphenol, n-nonylphenyl, p-tert-octylphenyl, p-tert-nonylphenol, decylphenol, dodecylphenyl, tetradecylphenol or hexadecylphenol.

The alfols are linear primary alcohols. The number after the names indicates the average number of carbon atoms which the alcohol contains. Some representatives of these alfols are: alfol (6–8), (8–10), (10–14), (12), (16), (18) and (20–22).

The radical $R_2$—COO— is derived e.g. from fatty acids containing 8 to 22 carbon atoms, for example caprylic, pelargonic, capric, lauric, myristic, palmitic, stearic, arachidic, behenic, coconut fatty, tallow fatty, decenoic, linolic, linolenic, oleic, ricinoleic, eicosenoic, docosenoic or clupanodonic acid.

$R_3$ is preferably an alkyl or alkenyl radical of 12 to 22, in particular 16 to 22, carbon atoms, and each of $Y_1$ and $Y_2$ is preferably hydrogen. The sum of r+s is advantageously 6 to 8. Each of $Y_1$ and $Y_2$ can have different meanings in the same molecule.

$R_3$ as alkyl can be e.g. n-dodecyl, myristyl, n-hexadecyl, n-heptadecyl, n-octadecyl, arachidyl or behenyl. $R_3$ as alkenyl can be e.g. dodecenyl, hexadecenyl, oleyl or octadecenyl.

The aliphatic amines which are required as starting materials for obtaining the preferred adducts of the formula (4) can contain saturated or unsaturated, branched or unbranched hydrocarbon radicals. These hydrocarbon radicals preferably contain 16 to 22 carbon atoms.

The amines can be chemically homogeneous or in the form of mixtures. Mixtures of amines are preferably those which are formed during the conversion of natural fats or oils, e.g. tallow fat, soybean or coconut oil, into the corresponding amines. Specific examples of amines are dodecylamine, hexadecylamine, heptadecylamine, octadecylamine, tallow fatty amine, arachidylamine, behenylamine and octadecenylamine (oleylamine).

Adducts with the amines can be formed with ethylene oxide or, to introduce the methyl or phenyl group into the ethyleneoxy groups, also with propylene oxide and/or styrene oxide. Propylene oxide is preferably used in admixture with ethylene oxide. It is advantageous to use, per mole of amine, 5 to 15 moles of propylene oxide and at least 10 moles of ethylene oxide. The addition of styrene oxide is advantageously effected before the addition of ethylene oxide. In this case, it is preferred to use, per mole of amine, 1 mole of styrene oxide and 15 to 30 moles of ethylene oxide.

The acid radical X can be derived from an organic, preferably aliphatic dicarboxylic acid containing 2 to 6 carbon atoms, for example maleic acid, malonic acid, succinic acid or, in particular, sulfosuccinic acid, or it can be introduced by reaction with a haloacetic acid, for example chloroacetic acid. In particular, however, X is derived from an inorganic polyvalent oxyacid, for example orthophosphoric acid or sulfuric acid.

The acid radical X exists preferably in salt form, that is to say e.g. as alkali metal, alkaline earth metal, ammonium or amine salt. Examples of such salts are: sodium, potassium, calcium, ammonium, trimethylamine, ethanolamine, diethanolamine or triethanolamine salts. Sodium and ammonium salts are preferred.

The alkylene oxide units $$\left(\underset{Y_1}{\underset{|}{CH}}\underset{Y_2}{\underset{|}{CH}}-O\right)$$

are as a rule ethylene oxide or 1,2-propylene oxide units. The latter are preferably in admixture with ethylene oxide units in the compounds of the formula (2) to (4).

Preferred components (b) are compounds of the formula (2), wherein $R_1$ is alkylphenyl containing 4 to 12 carbon atoms in the alkyl moiety, o-phenylphenyl, or alkyl or alkenyl, each containing 12 to 18 carbon atoms, and m is 2 to 15. A particularly suitable anionic surfactant is that of the formula

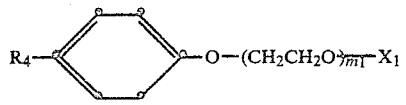

(5)

wherein $R_4$ is octyl or nonyl, $m_1$ is 2 to 10, $X_1$ is derived from sulfuric acid or orthophosphoric acid, and the surfactant is in the form of the free acid or the sodium or ammonium salt.

Particularly interesting anionic surfactants are also those of the formula (4), wherein $R_3$ is alkenyl or, most preferably, alkyl, each of 16 to 22 carbon atoms, each of $Y_1$ and $Y_2$ is hydrogen, the sum of r+s is 2 to 10, in particular 4 to 10, X is —$SO_3M$, and M is sodium or —$NH_4$.

Suitable non-aromatic and water-immiscible solvents which are used as component (c) are in particular water-immiscible aliphatic, araliphatic and/or cycloaliphatic solvents. Examples of such solvents are: monohydric or dihydric aliphatic alcohols containing at least 5 carbon atoms, e.g. n-amyl alcohol, 2-ethylbutanol, trimethylhexanol, neopentyl glycol, and araliphatic alcohols, such as benzyl alcohol and furfuryl alcohol; esters, for example alkyl acetates containing 1 to 5 carbon atoms, such as methyl acetate, ethyl acetate or propyl acetate, phenyl acetate, benzyl acetate, methyl or ethyl lactate, cyclic diesters of carbonic acid with glycols, in particular with propylene glycol, such as propylene carbonate; amides, such as diethyl acetoacetamide, N,N-diethyl thiourea, tributylphosphate, polyhalogenated paraffin or aliphatic or cycloaliphatic hydrocarbons. Aliphatic hydrocarbons are preferably paraffin oils which have as low a pour point as possible (e.g. below −20° C.), a high boiling point (e.g. above 300° C.) and a low viscosity (e.g. 5 to 60 cS at 50° C.). Cycloaliphatic hydrocarbons are in particular cyclopentane, cyclohexane and decalin (decahydronaphthalene). Component (c) is preferably an aliphatic water-immiscible solvent, in particular n-amyl alcohol or paraffin oil.

The dyeing assistant of the present invention can additionally contain water and/or a water-miscible solvent as polar solvent (d). The purpose of this additional component is to improve the homogeneity of the emulsion. Examples of water-miscible organic solvents are aliphatic $C_1$–$C_4$ alcohols such as methanol, ethanol or the propanols; ketones, such as acetone, methyl ethyl ketone, cyclohexanone, diacetone alcohol, ethers and acetates such as diisopropyl ether, diphenylene oxide, dioxane, tetrahydrofurane; monoalkyl ethers of glycols such as ethylene glycol monomethyl, monoethyl and monobutyl ether, and diethylene glycol monomethyl or monoethyl ether; tetrahydrofurfuryl alcohol, pyridine, acetonitrile, γ-butyrolactone, N,N-dimethyl formamide, N,N-dimethyl acetamide, tetramethyl urea, tetramethylene sulfone and the like. Mixtures of these solvents can also be employed. Preferred water-miscible solvents are isopropanol, β-ethoxyethanol and diacetone alcohol.

In addition to components (a), (b), (c) and (d), the dyeing assistant of the present invention can also contain a non-ionic surfactant as component (e). Component (e) is advantageously a non-ionic alkylene oxide adduct of 1 to 100 moles of alkylene oxide, e.g. ethylene oxide and/or propylene oxide, with 1 mole of an aliphatic monoalcohol containing at least 4, preferably 8, carbon atoms, of a trivalent to hexavalent aliphatic alcohol containing 2 to 9 carbon atoms, of a phenol which is unsubstituted or substituted by alkyl, benzyl or phenyl, or of a fatty acid containing 8 to 22 carbon atoms.

The aliphatic monoalcohols employed for obtaining component (e) are e.g. water-insoluble monoalcohols containing at least 4, preferably 8 to 22, carbon atoms. These alcohols can be saturated or unsaturated and branched or straight chain, and they can be employed by themselves or in mixtures with one another. It is possible to react natural alcohols, e.g. myristyl alcohol, cetyl alcohol, stearyl alcohol or oleyl alcohol, or synthetic alcohols, preferably 2-ethyl-hexanol, and also trimethyl hexanol, trimethylnonyl alcohol, hexadecyl alcohol or the above alfols, with the alkylene oxide.

Further aliphatic alcohols which can be reacted with alkylene oxide are trivalent or hexavalent alkanols. These alkanols contain 3 to 6 carbon atoms and are in particular glycerol, trimethylolethane, trimethylolpropane, erythritol, mannitol, pentaerythritol and sorbitol. The trivalent to hexavalent alcohols are preferably reacted with propylene oxide or ethylene oxide or with mixtures of these alkylene oxides.

Examples of suitable unsubstituted or substituted phenols are: phenol, benzylphenol, dibenzylphenol, benzyl(nonyl)phenol, o-phenylphenol or alkylphenols containing 1 to 16, preferably 4 to 12, carbon atoms in the alkyl moiety. Examples of these alkylphenols are: p-cresol, butylphenol, tributylphenol, octylphenol and, in particular, nonylphenol.

The fatty acids preferably contain 8 to 22 carbon atoms and can be saturated or unsaturated. Examples of these fatty acids are: caprylic, capric, pelargonic, lauric, myristic, palmitic or stearic acid, and decenoic, dodecenoic, tetradecenoic, hexadecenoic, oleic, linolic, linolenic or ricinoleic acid.

Preferred alkylene oxide reaction products which are employed as component (e) can be illustrated by the formula $$R_5-O-(CH_2-CH_2-O)_{n_1}-(\underset{Z_1}{CH}-\underset{Z_2}{CH}-O)_z-CH_2CH_2O)_{n_2}-H \quad (6)$$

wherein $R_5$ is hydrogen, alkyl or alkenyl, each containing 4 to 18 carbon atoms, o-phenylphenyl or alkylphenyl containing 4 to 12 carbon atoms in the alkyl moiety, one of $Z_1$ and $Z_2$ is hydrogen and the other is methyl, z is 1 to 15 and the sum of $n_1+n_2$ is 5 to 10.

Component (e) is advantageously combined with a component (b) of the formula (2) or (5).

If desired, the dyeing assistants of the present invention can additionally contain fatty acid salts of polyvalent metals which act as foam inhibiting component (f) and which can be present preferably in an amount from 0.2 to 5% by weight, based on the dyeing assistant. These metal salts are e.g. fatty acid salts of magnesium, calcium, strontium, barium, zinc or aluminium. Fatty acid salts of alkaline earth metal salts and of aluminium are preferred. These salts can be mono-, di- or tri-fatty acid salts, which can be used singly or in admixture. They should be in the solid aggregate state at room temperature. Suitable acids are the above mentioned fatty acids, which can be saturated or unsaturated and contain preferably 8 to 22 carbon atoms.

The novel dyeing assistant preparations can be obtained by simply stirring the components (a), (b), (c) and optionally (d), (e) and/or (f), to produce homogeneous clear mixtures which are stable at room temperature.

The assistant preparations advantageously contain
30 to 80% by weight of component (a)
5 to 30% by weight of component (b)
5 to 20% by weight of component (c)
5 to 40% by weight of component (d)
0 to 10% by weight, preferably 3 to 10% by weight, of component (e) and
0 to 5% by weight, preferably 0.2 to 5% by weight, of component (f),
the amounts being based in each case on the weight of the entire preparation.

The novel dyeing assistant preparations are suitable in particular for promoting the diffusion and migration of dyes in dyeing synthetic fibre material. Accordingly, the invention also provides a process for dyeing synthetic fibre material with cationic or disperse dyes, which comprises dyeing said material in the presence of the dyeing assistant of the invention. Disperse dyes are preferred.

The amount in which the dyeing assistant of the invention is added to the dyebaths varies from 0.5 to 6% by weight, preferably from 1 to 4% by weight, based on the weight of the material to be dyed.

Suitable fibre material, in particular textile material, which can be dyed in the presence of the dyeing assistant mixture of the present invention is e.g. material made from cellulose esters, such as cellulose 2½-acetate and cellulose triacetate fibres, from polyamide fibres, e.g. from ε-caprolactam, from adipic acid and hexamethylenediamine, and from ω-aminoundecanoic acid; aromatic polyamide fibres which are derived e.g. from poly-(meta-phenylene-isophthalamide), polyacrylonitrile fibres, including modacryl fibres, acid modified polyester fibres and, in particular, linear polyester fibres. Cellulose ester, polyamide and polyester fibres and preferably dyed with disperse dyes, and polyacrylonitrile fibres, acid modified polyester fibres and aromatic polyamide fibres are preferably dyed with cationic dyes.

Linear polyester fibres are to be construed as meaning synthetic fibres which are obtained e.g. by condensation of terephthalic acid with ethylene glycol or of isophthalic acid or terephthalic acid with 1,4-bis-(hydroxymethyl)cyclohexane, as well as copolymers of terephthalic acid and isophthalic acid and ethylene glycol. To the acrylic fibres which can be dyed by the process of the invention belong the commercially available types of polymers and copolymers of acrylonitrile. The content of acrylonitrile in acrylonitrile copolymers is advantageously 80% by weight, based on the weight of the copolymer. Acid modified polyester fibres are e.g. polycondensates of terephthalic acid or isophthalic acid, ethylene glycol and 1,2- or 1,3-dihydroxy-3-(3-sodium sulfopropoxy)propane, 2,3-dimethylol-1-(sodium sulfopropoxy)butane, 2,2-bis-(3-sodium sulfopropoxyphenyl)propane or 3,5-dicarboxybenzenesulfonic acid or sulfonated terephthalic acid, sulfonated 4-methoxybenzenecarboxylic acid or sulfonated diphenyl-4,4'-dicarboxylic acid.

The fibre materials can also be employed as blends with another or with other fibres, e.g. blends of polyacrylonitrile/polyester, polyamide/polyester, polyester/cotton, polyester/viscose and polyester/wool.

The textile material to be dyed can be in different states of processing, for example loose material, piece goods, such as knits or wovens, and yarn in wound or muff form.

Cationic dyes suitable for the process of the invention can belong to various classes of dye. In particular, they comprise the customary salts, for example chlorides, sulfates or metal halides, for example zinc chloride double salts, of cationic dyes whose cationic character derives for example from a carbonium, oxonium, sulfonium or, above all, ammonium group. Examples of such chromophoric systems are azo dyes, primarily monoazo or hydrazone dyes, diphenylmethane, triphenylmethane, methine or azomethine dyes, coumarin, ketoneimine, cyanine, xanthene, azine, oxazine or thiazine dyes. Finally, it is also possible to use dye salts of the phthalocyanine or anthraquinone series with an external onium group, for example an alkylammonium or cycloammonium group and also benzo-1,2-pyrane dye salts which contain cycloammonium groups.

The disperse dyes to be used, which are soluble in water to only a very limited degree and are present in the dye liquor for the most part in the form of a fine dispersion, can belong to the most diverse dyestuff classes, for example to the acridone, azo, anthraquinone, coumarin, methine, perinone, naphthoquinoneimine, quinophthalone, sytryl or nitro dyes.

It is also possible to use mixtures of cationic or disperse dyes in the process of the invention.

The amount of dye to be added to the liquor depends on the desired colour strength; in general, amounts of 0.1 to 10% by weight, based on the weight of the textile material employed, have proved to be advantageous.

The dyeing assistants of the invention can also be employed in admixture with known carriers based on e.g. di- or trichlorobenzene, o-phenylphenol, benzylphenol, diphenyl, diphenyl ether, chlorodiphenyl, methyldiphenyl, methyldiphenyl ether, butylbenzoate, methylbenzoate, phenylbenzoate, dibenzyl ether, alkylphenylbenzoates, dimethyl phthalate, cyclohexanone, acetophenone, alkylphenoxyethanol, mono-, di and trichlorophenoxyethanol or trichlorophenoxypropanol or pentachlorophenoxyethanol.

The carriers are used preferably in an amount of 0.1 to 2 g/l of dye liquor or 5 to 30% by weight, based on the entire dyeing assistant.

Depending on the textile material to be dyed, the dyebaths can contain, in addition to the dyes and the dyeing assistant, oligomer inhibitors, antifoams, anticrease agents, retarders and, preferably, dispersants.

The purpose of the dispersants is in particular to obtain a good dispersion of the disperse dyes. Suitable dispersants are those customarily employed in dyeing with disperse dyes. Preferred dispersants are sulfated or phosphated adducts of 15 to 100 moles of ethylene oxide or preferably propylene oxide with polyhydric aliphatic alcohols containing 2 to 6 carbon atoms, e.g. ethylene glycol, glycerol or pentaerythritol, or with amines containing 2 to 9 carbon atoms and at least two amino groups or one amino group and one hydroxyl group, as well as alkylsulfonates containing 10 to 20 carbon atoms in the alkyl chain, alkylbenzenesulfonates with straight or branched alkyl chain containing 8 to 20 carbon atoms, e.g. nonyl- or dodecylbenzenesulfonate, 1,3,5,7-tetramethyloctylbenzenesulfonate or octadecylbenzenesulfonate, ligninsulfonates, and alkylnaphthalenesulfonates, for example bisnaphthylmethanesulfonate or sulfosuccinates, such as sodium dioctylsulfosuccinate.

It is also possible to employ mixtures of anionic dispersants. Normally the anionic dispersants are in the form of their alkali metal salts, ammonium salts or amine salts. These dispersants are preferably employed in an amount of 0.1 to 5 g/l of dye liquor.

The dyebaths can also contain conventional additives, advantageously electrolytes, such as salts, for example sodium sulfate, ammonium sulfate, sodium or ammonium phosphates or sodium or ammonium polyphosphates, ammonium acetate or sodium acetate and/or acids, e.g. mineral acids, such as sulfuric acid or phosphoric acid, or organic acids, preferably lower aliphatic carboxylic acids, such as formic acid, acetic acid or oxalic acid. The acids are used in particular for adjusting the pH value of the dyebaths employed in the invention. The pH value is ordinarily in the range between 4 and 6.5, preferably between 4.5 to 6.

Dyeing is performed advantageously from an aqueous liquor by the exhaust method. The liquor ratio can accordingly be chosen within a wide range, e.g. from 1:4 to 1:100, preferably from 1:10 to 1:50. The dyeing temperature is at least 70° C. and is ordinarily not higher than 140° C. Preferably it is in the range from 80° to 130° C.

Linear polyester fibres and cellulose triacetate fibres are preferably dyed by the high temperature process in closed and advantageously also pressure-resistant machines at temperatures above 100° C., preferably in the range between 110° and 130° C., and optionally under pressure. Examples of suitable closed dyeing machines are circulating liquor machines such as cheese dyeing and beam dyeing machines, winch becks, jet dyeing or rotary dyeing machines, muff dyeing machines, paddles or jiggers.

Cellulose 2½-acetate fibres are preferably dyed at temperatures from 80° to 85° C., whilst polyamide and polyacrylonitrile fibres are dyed with advantage at the boiling point of the aqueous bath (98° C.). Aromatic polyamide fibres or acid modified polyester fibres are preferably dyed at a temperature from 80° to 130° C.

The dyeing process of the present invention can be carried out such that the material to be dyed is either briefly treated first with the dyeing assistant and then dyed, or simultaneously with the assistant and the dye. In both methods, the dye liquor is cooled to about 60° C. when the dyeing is complete, the goods are rinsed with water and, if desired, e.g. when polyester material is dyed, given a reductive after-clear in alkali medium in conventional manner. The goods are then again rinsed and dried.

Level and strong dyeings, which in addition are distinguished by good fastness to rubbing and good dye yields, are obtained on synthetic fibre material, especially on linear polyester fibres, by the process of the invention. The other fastness properties of the dyeings, e.g. lightfastness, are not influenced by the use of the assistant of the invention.

In the following Examples, the parts and percentages are by weight. The following reaction products are examples of components (b) and (e):

Component (b):

$B_1$—the ammonium salt of the acid sulfuric acid ester of the adduct of 1 mole of ethylene oxide and 1 mole of alfol (1014);

$B_2$—the ammonium salt of the acid sulfuric acid ester of the adduct of 1 mole of ethylene oxide and 1 mole of stearyl alcohol;

$B_3$—the ammonium salt of the acid sulfuric acid ester of the adduct of 1 mole of ethylene oxide and 1 mole of 2-ethyl-hexanol;

$B_4$—the ammonium salt of the acid sulfuric acid ester of the adduct of 35 moles of ethylene oxide and 1 mole of stearyl alcohol;

$B_5$—the ammonium salt of the acid sulfuric acid ester of the adduct of 3 moles of ethylene oxide and 1 mole of tridecyl alcohol;

$B_6$—the ammonium salt of the acid sulfuric acid ester of the adduct of 4 moles of ethylene oxide and 1 mole of hydroabietyl alcohol;

$B_7$—the ammonium salt of the acid sulfuric acid ester of the adduct of 3 moles of ethylene oxide and 1 mole of alfol (2022);

$B_8$—the ammonium salt of the acid sulfuric acid ester of the adduct of 3 moles of ethylene oxide and 1 mole of lauryl alcohol;

$B_9$—the ammonium salt of the acid sulfuric acid ester of the adduct of 3 moles of ethylene oxide and 1 mole of butylphenol;

$B_{10}$—the ammonium salt of the acid sulfuric acid ester of the adduct of 5 moles of ethylene oxide and 1 mole of tributylphenol;

$B_{11}$—the ammonium salt of the acid sulfuric acid ester of the adduct of 2 moles of ethylene oxide and 1 mole of nonylphenol;

$B_{12}$—the ammonium salt of the acid sulfuric acid ester of the adduct of 10 moles of propylene oxide and 10 moles of ethylene oxide and 1 mole of nonylphenol;

$B_{13}$—the ammonium salt of the acid sulfuric acid ester of the adduct of 35 moles of ethylene oxide and 1 mole of nonylphenol;

$B_{14}$—the ammonium salt of the acid sulfuric acid ester of the adduct of 50 moles of ethylene oxide and 1 mole of nonylphenol;

$B_{15}$—the ammonium salt of the acid sulfuric acid ester of the adduct of 15 moles of propylene oxide and 1 mole of nonylphenol;

$B_{16}$—the ammonium salt of the acid sulfuric acid ester of the adduct of 6 moles of ethylene oxide and 1 mole of dodecylphenol;

$B_{17}$—the ammonium salt of the acid sulfuric acid ester of the adduct of 6 moles of ethylene oxide and 1 mole of pentadecylphenol;

$B_{18}$—the ammonium salt of the acid sulfuric acid ester of the adduct of 8 moles of ethylene oxide and 1 mole of o-phenylphenol;

$B_{19}$—the ammonium salt of the acid sulfuric acid ester of the adduct of 2 moles of ethylene oxide and 1 mole of coconut fatty acid;

$B_{20}$—the ammonium salt of the acid sulfuric acid ester of the adduct of 2 moles of propylene oxide and 1 mole of coconut fatty acid;

$B_{21}$—the ammonium salt of the acid sulfuric acid ester of the adduct of 15 moles of ethylene oxide and 1 mole of stearic acid $\beta$-hydroxyethylamide;

$B_{22}$—the ammonium salt of the acid sulfuric acid ester of the adduct of 2.5 moles of ethylene oxide and 1 mole of tallow fatty amine;

$B_{23}$—the ammonium salt of the acid disulfuric acid ester of polybutylene glycol having an average molecular weight of 2,000;

$B_{24}$—the sodium salt of the acid maleic acid ester of the adduct of 2 moles of ethylene oxide and 1 mole of p-nonylphenol;

$B_{25}$—the sodium salt of the acid monosulfosuccinic acid ester of the adduct of 2 moles of ethylene oxide and 1 mole of p-nonylphenol;

$B_{26}$—the sodium salt of the acid dimaleic acid ester of polypropylene glycol having an average molecular weight of 1,000;

$B_{27}$—the ammonium salt of the acid phosphoric acid ester of the adduct of 2 moles of ethylene oxide and 1 mole of nonylphenol;

$B_{28}$—the acid phosphoric acid ester of the adduct of 10 moles of ethylene oxide and 1 mole of p-nonylphenol;

$B_{29}$—the sodium salt of the carboxymethylether of the adduct of 4 moles of ethylene oxide and 1 mole of octylphenol;

$B_{30}$—the di-($\beta$-hydroxyethyl)amine salt of the acid sulfuric acid ester of the adduct of 3 moles of ethylene oxide and 1 mole of lauryl alcohol;

$B_{31}$—the sodium salt of the acid sulfuric acid ester of the addust of 2 moles of ethylene oxide and 1 mole of lauryl alcohol;

$B_{32}$—the sodium salt of the acid sulfuric acid ester of the adduct of 3 moles of ethylene oxide and 1 mole of lauryl alcohol;

$B_{33}$—the ammonium salt of the acid sulfuric acid ester of the adduct of 8 moles of ethylene oxide and 1 mole of tallow fatty amine;

$B_{34}$—the ammonium salt of the acid sulfuric acid ester of the addust of 2, 4 or 6 moles of ethylene oxide and 1 mole of tallow fatty amine;

$B_{35}$—the ammonium salt of the acid sulfuric acid ester of the adduct of 3 moles of propylene oxide and 5 moles of ethylene oxide and 1 mole of tallow fatty amine;

$B_{36}$—the ammonium salt of the acid sulfuric acid ester of the adduct of 1 mole of styrene oxide and 8 moles of ethylene oxide and 1 mole of dodecylamine;

$B_{37}$—the sodium salt of the acid sulfosuccinic acid hemiester of the adduct of 8 moles of ethylene oxide and 1 mole of tallow fatty amine; and $B_{38}$—the ammonium salt of the acid phosphoric acid ester of the adduct of 8 moles of ethylene oxide and 1 mole of tallow fatty amine;

$B_{39}$—the acid phosphoric acid ester of the adduct of 5 moles of ethylene oxide and 1 mole of 2-ethyl-n-hexanol; and $B_{40}$—the sodium salt of the acid sulfuric acid ester of the adduct of 15 moles of ethylene oxide and 1 mole of dibenzylphenol.

Component (e):

$E_1$—the reaction of 3 moles of ethylene oxide and 1 mole of 2-ethyl-hexanol;

$E_2$—the reaction product of 5 moles of ethylene oxide and 1 mole of 2-ethyl-hexanol;

$E_3$—the reaction product of 3 moles of ethylene oxide and 1 mole of stearyl alcohol;

$E_4$—the reaction product of 9 moles of ethylene oxide and 1 mole of alfol (1014);

$E_5$—the reaction product of 3 moles of ethylene oxide and 1 mole of hexadecyl alcohol;

$E_6$—the reaction product of 6 moles of ethylene oxide and 1 mole of oleyl alcohol;

$E_7$—the reaction product of 1 mole of ethylene oxide and 1 mole of phenol;

$E_8$—the reaction product of 4 moles of ethylene oxide and 1 mole of p-cresol;

$E_9$—the reaction product of 5 moles of ethylene oxide and 1 mole of tributylphenol;

$E_{10}$—the reaction product of 8 moles of ethylene oxide and 1 mole of octylphenol;

$E_{11}$—the reaction product of 9 moles of ethylene oxide and 1 mole of nonylphenol;

$E_{12}$—the reaction product of 4 moles of ethylene oxide and 1 mole of nonylphenol;

$E_{13}$—the reaction product of 6 moles of ethylene oxide and 1 mole of nonylphenol;

$E_{14}$—the reaction product of 8 moles of ethylene oxide and 1 mole of o-phenylphenol;

$E_{15}$—the reaction product of 51 moles of propylene oxide and 5 moles of ethylene oxide and 1 mole of glycerol;

$E_{16}$—the reaction product of 51 moles of propylene oxide and 12 moles of ethylene oxide an 1 mole of glycerol;

$E_{17}$—the reaction product of 3 moles of ethylene oxide and 1 mole of oleic acid;

$E_{18}$—the reaction product of 2 moles of polypropylene glycol (molecular weigh 1000) and 1 mole of adipic acid;

$E_{19}$—the reaction product of 12 moles of ethylene oxide and 12 moles of propylene oxide and 1 mole of $C_4$-$C_{18}$ fatty alcohol;

$E_{20}$—the reaction product of 80 moles of ethylene oxide and 1 mole of oleyl alcohol;

$E_{21}$—mixture of a reaction product of 12 moles of ethylene oxide and 12 moles of propylene oxide and 1 mole of a $C_4$-$C_{18}$ fatty alcohol and a poly(oxyethylene)$_{12}$-poly(oxypropylene)$_{12}$ block polymer;

$E_{22}$—the reaction product of 5 moles of ethylene oxide and 5 moles of propylene oxide and 1 mole of alfol (12–14).

EXAMPLE 1

The dyeing assistant ($P_1$) is prepared by mixing the individual components and employed as described below in the dyeing of polyester fibres:

| | |
|---|---|
| 600 g | of component $B_{28}$ |
| 300 g | of n-amyl alcohol |
| 300 g | of diacetone alcohol |
| 1800 g | of methyl ethyl benzene and trimethylbenzene |
| 3000 g | |

100 kg of polyethylene glycol terephthalate fabric are pre-wetted in 1000 liters of water in a beam dyeing machine. The liquor is then heated to 70° C., whereupon the following ingredients are added:

2000 g of ammonium sulfate 3000 g of the dyeing assistant $P_1$ and 4000 g of a disperse dye of the formula

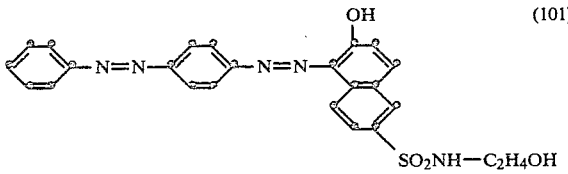

(101)

The pH of the dyebath is then adjusted with 85% formic acid to 5.5 and the bath is heated in the course of 30 minutes to 120° C. Dyeing is carried out for 30 minutes at this temperature, then the bath is cooled and the goods are rinsed and dried. A strong red dyeing which is fast to rubbing is obtained.

By carrying out the same procedure, but without addition of the assistant $P_1$, the dyeing is 40% lighter in strength.

A strong red dyeing which is fast to rubbing is also obtained by using, instead of the dyeing assistant $P_1$, the same amount of the following preparations $P_2$ to $P_9$ $P_2$) preparation consisting of

| | |
|---|---|
| 2100 g | of methyl ethyl benzene/trimethylbenzene |
| 333 g | of paraffin oil |
| 180 g | of component $B_{11}$ |
| 180 g | of water |
| 40 g. | of isopropanol |
| 167 g | of component $E_{19}$ or $E_{21}$ |
| 3000 g | |

$P_3$) preparation consisting of

| | |
|---|---|
| 1800 g | of methyl ethyl benzene/trimethylbenzene |
| 300 g | of diphenyl |
| 333 g | of paraffin oil |
| 180 g | of component $B_{11}$ |
| 180 g | of water |
| 40 g | of isopropanol |
| 167 g | of component $E_{22}$ |
| 3000 g | |

$P_4$) preparation consisting of

| | |
|---|---|
| 600 g | of component $B_{28}$ |
| 300 g | of n-amyl alcohol |
| 300 g | of diacetone alcohol |
| 1785 g | of methyl ethyl benzene/trimethylbenzene |
| 15 g | of magnesium stearate |
| 3000 g | |

$P_5$) preparation consisting of

| | |
|---|---|
| 2100 g | of methyl ethyl benzene/trimethylbenzene |
| 333 g | of paraffin oil |
| 180 g | of component $B_{11}$ |
| 180 g | of water |
| 40 g | of isopropanol |
| 167 g | of component $E_{11}$ |
| 3000 g | |

$P_6$) preparation consisting of

| | |
|---|---|
| 1050 g | of methyl ethyl benzene/trimethylbenzene |
| 1050 g | of tetralin (tetrahydronaphthalene) |
| 333 g | of paraffin oil |
| 180 g | of component $B_{11}$ |
| 180 g | of water |
| 40 g | of isopropanol |
| 167 g | of component $E_{11}$ |
| 3000 g | |

$P_7$) preparation consisting of

| | |
|---|---|
| 2100 g | of tetralin |
| 333 g | of paraffin oil |
| 180 g | of component $B_{11}$ |
| 180 g | of water |
| 40 g | of isopropanol |
| 167 g | of component $E_{11}$ |
| 3000 g | |

$P_8$) preparation consisting of

| | |
|---|---|
| 1050 g | of tetralin |
| 1050 g | of xylene |
| 333 g | of paraffin oil |
| 180 g | of component $B_{11}$ |
| 180 g | of water |
| 40 g | of isopropanol |
| 167 g | of component $E_{11}$ |
| 3000 g | |

$P_9$) preparation consisting of

| | |
|---|---|
| 900 g | of methyl ethyl benzene/trimethylbenzene |
| 810 g | of isobutanol |
| 900 g | of component $B_{28}$ |
| 300 g | of component $E_{10}$ |
| 90 g | of monoethanolamine |
| 3000 g | |

When using assistant $P_4$ an improvement in the passage of the goods as a result of reduced foam formation is additionally observed.

EXAMPLE 2

100 kg of polyethylene glycol terephthalate yarn are heated in 1200 liters of water in a muff dyeing machine. The following ingredients are then added to the dyebath:

2400 g of ammonium sulfate
2000 g of assistant $P_1$ of Example 1
2000 g of an ammonium salt of the formula

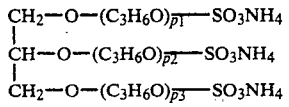

(7)

$p_1+p_2+p_3=60$ and 200 g of a dye of the formula (102)

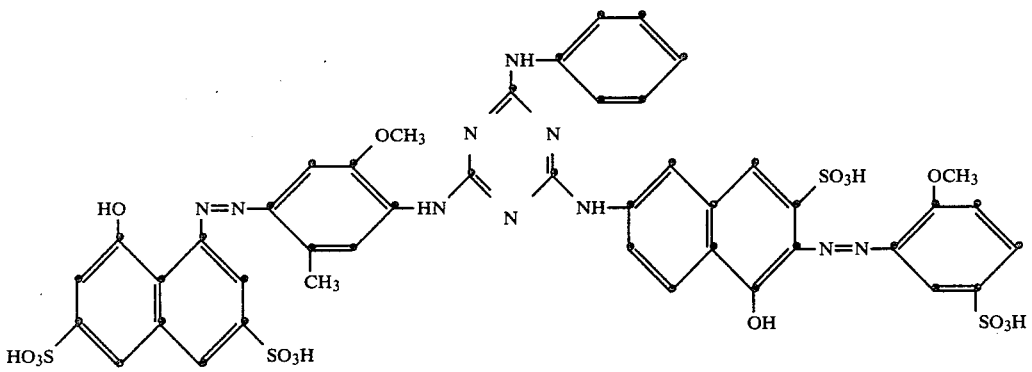

10 g of a dye of the formula (106)

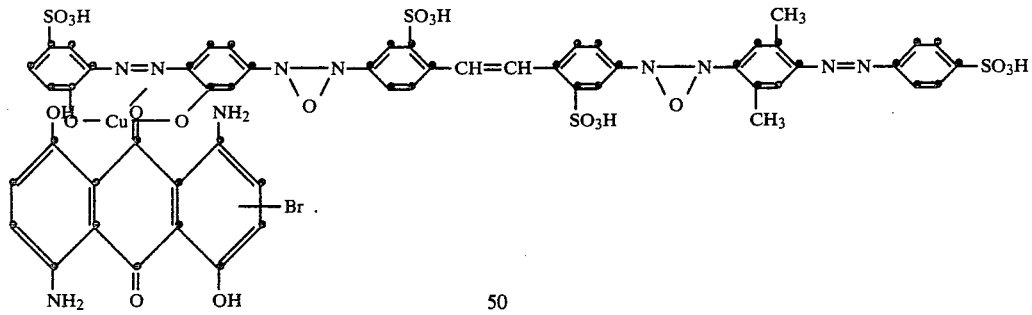

The dyebath is adjusted to a pH value of 5 with 85% formic acid and heated in the course of 45 minutes to 115° C. Dyeing is then carried out for 60 minutes at this temperature. The bath is then cooled and the goods are rinsed and dried. A strong, level blue dyeing of good fastness to rubbing is obtained.

By dyeing the goods from a dyebath which does not contain assistant $P_1$, the dyeing is 30% weaker in strength. By carrying out the same procedure, but using a conventional carrier such as o-phenylphenol or trichlorobenzene instead of assistant $P_1$, the levelness of the dyeing is distinctly poorer.

EXAMPLE 3

100 kg of a not previously cleaned fabric containing a residual fat content of 3.15% and consisting of 50% of cotton and 50% of polyester are treated for 20 minutes at 40° C. in a HT winch beck with an aqueous liquor (3000 liters) which contains 54 g of a dye of the formula (103)

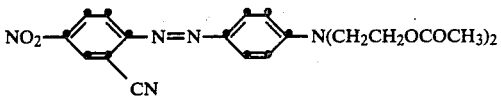

27 g of a dye of the formula (104)

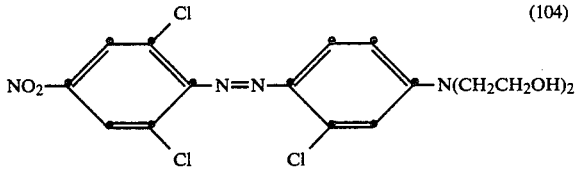

130 g of a dye of the formula (105)

10 g of a dye of the formula (106)

3500 g of the dyeing assistant $P_1$ of Example 1, and 6000 g of ammonium sulfate. The dyebath has a pH value of 5.6. Then 10 kg of calcined Glauber's salt are added and the bath is heated to 115° in the course of 40 minutes. Dyeing is carried out for 30 minutes at this temperature and the bath is then cooled. The goods are subsequently rinsed and dried. The fabric is dyed in a strong and level beige shade and additionally has a residual fat content of only 0.65%.

EXAMPLE 4

(a) In a dyeing machine (autoclave), 50 g of texturised polyethylene glycol terephthalate are put at 70° C. into an aqueous liquor (3 liters) which contains 2.6% of a dye of the formula (101), 0.8% of a dye of the formula (102), 2.9% of a dye of the formula (107)

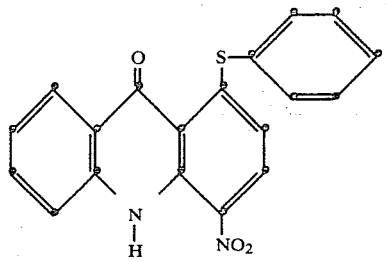

and 2 g/l of ammonium sulfate, and which is adjusted with 85% formic acid to a pH value of 5. The dyebath is heated in the course of 30 minutes to 130° C. and the goods are dyed for 1 hour at this temperature. The bath is cooled and the goods are then rinsed and, together with untreated fabric, treated as follows:

(b) In an autoclave, 5 g of the fabric dyed in (a) and 5 g of the untreated fabric are put into a dyebath which contains 0.5 g of ammonium sulfate, 1 g of the dyeing assistant $P_1$ of example 1, 06 g of the ammonium salt of the formula (7) of Example 2 and 300 g of water. The autoclave is then closed and heated in the course of 30 minutes to 125° C. Both pieces of fabric are treated for 1 hour at this temperature. Dyeings with a migration rating of 4–5 are obtained. By repeating the same procedure, but without the addition of the assistant $P_1$, dyeings having a migration rating of 1–2 are obtained. The poorest rating is 1 and the best 5.

EXAMPLE 5

In a beam dyeing machine, 100 kg of acid modified polyester fabric are wetted in 1000 liters of water at 60° C. The following ingredients are then added: 2000 g of 80% acetic acid, 6000 g of anhydrous sodium sulfate, 2000 g of assistant $P_3$ and 1100 g of a dye of the formula (108)

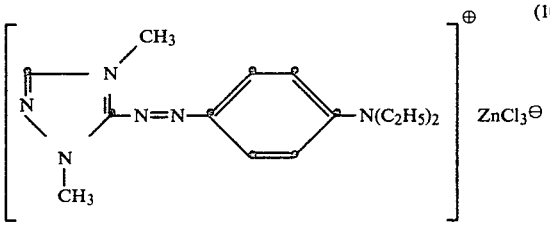

After these ingredients have been homogenised, the dyebath is heated in the course of 40 minutes to 120° C. and the goods are dyed for 60 minutes at this temperature. The bath is then cooled and the goods are rinsed and dried. A level and strong red dyeing is obtained.

By repeating the above procedure, but without addition of the assistant $P_3$, the dyeing is 20% lighter in strength.

EXAMPLE 6

In a jet dyeing machine, 100 kg of polyester filament woven fabric are put into 1000 liters of water at 70° C. Then the following ingredients are added to the bath: 750 g of the tetrasodium salt of ethylenediaminetetracetic acid, 1000 g of 60% acetic acid, 1000 g of a condensation product of naphthalene-2-sulfonic acid and formaldehyde, 750 g of the assistant $P_5$ and 1113 g of a dye of the formula (109)

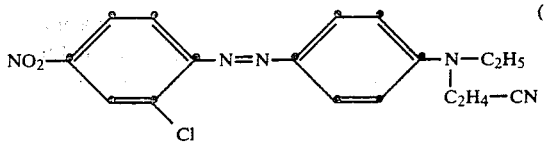

1300 g of a dyestuff of the formula (103) and 180 g of a dye which is obtained by reaction of a mixture of 1,8-diamino-4,5-dihydroxyanthraquinone and 1,5-diamino-4,8-dihydroxyanthraquinone with formaldehyde. After these ingredients have been homogenised, the dyebath is heated in the course of 75 minutes to 125° C. and dyeing is carried out for 20 minutes at this temperature. The bath is then cooled to 50° C. and the goods are rinsed and dried. A strong, red dyeing which is fast to rubbing (rating: 4–5) is obtained. By carrying out the same procedure, but with a dyebath which contains no assistant $P_5$, the dyeing is 25% lighter in shade and has poorer fastness to rubbing (rating 3).

EXAMPLE 7

On a HT winch beck, 100 kg of a polyester/wool fabric (55% polyester, 45% wool) are put into 4000 liters of water at 60° C. The following ingredients are then added to the bath: 800 g of the tetrasodium salt of ethylenediaminetetracetic acid, 2000 g of a condensation product of naphthalene-2-sulfonic acid and formaldehyde, 2000 g of a sulfated fatty amine polyglycol ether, 8000 g of the assistant $P_5$ and 4500 g of a dyestuff mixture consisting of 43 parts of a dye of the formula (110)

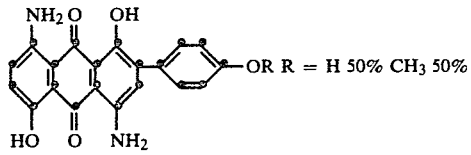

45 parts of a dye of the formula (111)

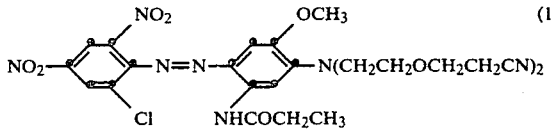

and 12 parts of a 1:2-chromium mixed complex with one dye of each of the formulae (112)

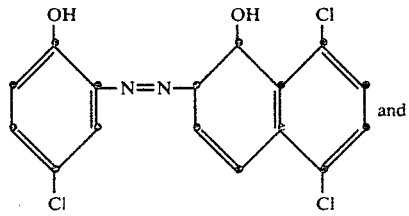

and

-continued

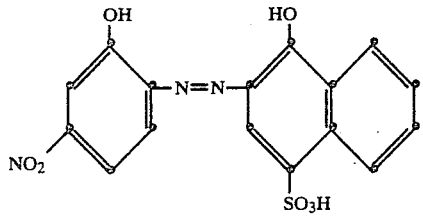

(113)

After the ingredients have been homogenised, the dyebath is adjusted with acetic acid to a pH value of 5.5 to 6. The bath is then heated in the course of 45 minutes to 120° C. and dyeing is carried out for 30 minutes at this temperature. The bath is then cooled to 45° C. and the goods are rinsed and dried. A level, blue solid shade dyeing which is fast to rubbing is obtained. By repeating the same dyeing procedure, but without addition of the assistant $P_5$, the polyester constituent is distinctly lighter in shade and the fastness to rubbing is poorer.

What is claimed:

1. A dyeing assistant which comprises at least
(a) an alkylbenzene or tetrahydronaphthalene or a mixture thereof,
(b) an anionic surfactant and
(c) a non-aromatic and water-immiscible solvent.

2. A dyeing assistant according to claim 1, which additionally comprises as component (d), a polar solvent.

3. A dyeing assistant according to claim 1, which additionally comprises as component (e), a non-ionic surfactant.

4. A dyeing assistant according to claim 1, which additionally comprises (d) a polar solvent and (e) a non-ionic surfactant.

5. A dyeing assistant according to claim 1, wherein component (a) is an alkylbenzene.

6. A dyeing assistant according to claim 5, wherein the alkylbenzene (a) is a benzene compound which is substituted with methyl, ethyl or a mixture thereof.

7. A dyeing assistant according to claim 1, wherein component (b) is an anionic surfactant of the formula $$Q-\left[(\underset{Y_1}{CH}-\underset{Y_2}{CH}-O)_m-X\right]_q \quad (1)$$

wherein

Q is $R_1$—O—, $R_2$—CO—O— or $R_3$—N<, $R_1$ is an aliphatic hydrocarbon radical of 8 to 24 carbon atoms, a cycloaliphatic hydrocarbon radical of 10 to 22 carbon atoms, o-phenylphenyl or alkylphenyl containing 4 to 16 carbon atoms in the alkyl moiety, $R_2$ is an aliphatic hydrocarbon radical of 7 to 21 carbon atoms, $R_3$ is an aliphatic hydrocarbon radical of 12 to 22 carbon atoms, one of $Y_1$ and $Y_2$ is hydrogen, methyl or phenyl and the other is hydrogen, X is the acid radical of an inorganic oxygen-containing acid or of a dicarboxylic acid or is the radical —$CH_2COOH$, m is 1 to 50, and q is 1 or, if Q is $R_3$—N<, q is 2, with the proviso that the two substituents at the nitrogen atom are the same or different.

8. A dyeing assistant according to claim 7, wherein component (b) is an anionic surfactant of the formula $$R_1-O-(\underset{Y_1}{CH}-\underset{Y_2}{CH}-O)_m-X \quad (2)$$

$$R_2-CO-O-(\underset{Y_1}{CH}-\underset{Y_2}{CH}-O)_m-X \text{ or} \quad (3)$$

$$R_3-N\left\langle\begin{array}{l}(\underset{Y_1}{CH}-\underset{Y_2}{CH}-O)_r-X\\(\underset{Y_1}{CH}-\underset{Y_2}{CH}-O)_s-X\end{array}\right. \quad (4)$$

wherein $R_1$, $R_2$, $R_3$, $Y_1$, $Y_2$, X and m are as defined in claim 7 and r and s are integers, the sum of which is 2 to 15.

9. A dyeing assistant according to claim 8, wherein component (b) is an anionic surfactant of the formula (2), wherein $R_1$ is alkylphenyl containing 4 to 12 carbon atoms in the alkyl moiety, o-phenylphenyl, or alkyl or alkenyl, each containing 12 to 18 carbon atoms, and m is 2 to 15.

10. A dyeing assistant according to claim 9, wherein component (b) is an anionic surfactant of the formula

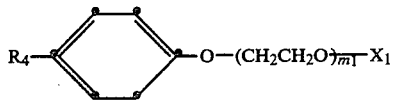

(5)

wherein $R_4$ is octyl or nonyl, $m_1$ is 2 to 10, $X_1$ is derived from sulfuric acid or orthophosphoric acid, and the surfactant is in the form of the free acid or the sodium or ammonium salt.

11. A dyeing assistant according to claim 8, wherein component (b) is an anionic surfactant of the formula (4), wherein $R_3$ is alkenyl or alkyl, each of 16 to 22 carbon atoms, each of $Y_1$ and $Y_2$ is hydrogen, the sum of r and s is 2 to 10, X is —$SO_3M$ and M is sodium or —$NH_4$.

12. A dyeing assistant according to claim 1, wherein component (c) is an aliphatic water-immiscible solvent.

13. A dyeing assistant according to claim 1, wherein component (c) is n-amyl alcohol or paraffin oil.

14. A dyeing assistant according to claim 2, wherein component (d) is water, isopropanol, β-ethoxyethanol or diacetone alcohol.

15. A dyeing assistant according to claim 3, wherein component (e) is a non-ionic alkylene oxide adduct of 1 to 100 moles of alkylene oxide with 1 mole of an aliphatic monoalcohol containing at least 8 carbon atoms, of a trivalent to hexavalent aliphatic alcohol containing 2 to 9 carbon atoms, of a phenol which is unsubstituted or substituted by alkyl, benzyl or phenyl, or a fatty acid containing 8 to 22 carbon atoms.

16. A dyeing assistant according to claim 15, wherein component (e) is a non-ionic surfactant of the formula $$R_5-O-(CH_2-CH_2-O)_{n_1}-(\underset{Z_1}{CH}-\underset{Z_2}{CH}-O)_z-CH_2CH_2O)_{n_2}-H \quad (6)$$

wherein $R_5$ is alkyl or alkenyl, each containing 8 to 18 carbon atoms, o-phenylphenyl or alkylphenyl containing 4 to 12 carbon atoms in the alkyl moiety, one of $Z_1$ and $Z_2$ is hydrogen and the other is methyl, z is 1 to 15 and the sum of $n_1+n_2$ is 5 to 10.

17. A dyeing assistant according to claim 3, wherein component (e) is used together with component (b) of the formula (2) or (5).

18. A dyeing assistant according to claim 1, which additionally contains, as component (f), a fatty acid salt of a polyvalent metal.

19. A dyeing assistant according to claim 1, which additionally contains a carrier.

20. A dyeing assistant according to claim 2, which contains 30 to 80% by weight of component (a), 5 to 30% by weight of component (b), 5 to 20 % by weight of component (c), 5 to 40% by weight of component (d) and 0 to 10% by weight of component (e), this amounts being based in each case on the weight of the entire assistant.

21. A dyeing assistant according to claim 20, which contains 3 to 10% by weight of component (e), based on the weight of the entire assistant.

22. A dyeing assistant according to claim 18, which additionally contains 0.2 to 5% by weight of a fatty acid salt of a polyvalent metal, based on the weight of the entire assistant.

23. A dyeing assistant according to claim 19, which additionally contains 5 to 30% by weight of a carrier, based on the weight of the entire assistant.

24. A process for dyeing synthetic fibre material with cationic or disperse dyes, which comprises dyeing said material in the presence of a dyeing assistant which comprises at least (a) an alkylbenzene or tetrahydroaphthalene, or a mixture thereof
(b) an anionic surfactant,
(c) a non-aromatic and water-immiscible solvent, and optionally,
(d) a polar solvent and/or
(e) a non-ionic surfactant.

25. A process according to claim 24 which comprises dyeing polyacrylonitrile fibres, acid modified polyester fibres or aromatic polyamide fibres with cationic dyes.

26. A process according to claim 24 which comprises dyeing polyester fibres with disperse dyes.

27. A process according to claim 24, wherein the dyebath additionally contains an anionic dispersant.

28. A process according to claim 24, whereing the dyebath contains 0.5 to 6% by weight of dyeing assistant, based on the weight of the fibre material.

29. A process to claim 24, wherein dyeing is carried out in the temperature range from 80° to 130° C.

30. A process according to claim 29, wherein dyeing is carried out in the temperature range from 80° to 98° C.

31. A process according to claim 29, wherein the dyeing of polyester fibre is carried out in the temperature range from 110° to 130° C.

32. A dyebath for dyeing synthetic fibre material which comprises least one cationic or disperse dye and a dyeing assistant containing at least (a) an alkylbenzene or tetrahydronaphthalene, or a mixture thereof,
(b) an anionic surfactant,
(c) a non-aromatic and water-immiscible solvent and optionally also
(d) a polar solvent and/or
(e) a non-ionic surfactant.

* * * * *